US008994487B2

(12) United States Patent
Lin et al.

(10) Patent No.: US 8,994,487 B2
(45) Date of Patent: Mar. 31, 2015

(54) TRANSFORMER

(75) Inventors: Han-Hsing Lin, Taoyuan Hsien (TW); Hsiang-Yi Tseng, Taoyuan Hsien (TW); Ching-Hsiang Tien, Taoyuan Hsien (TW); Hsin-Wei Tsai, Taoyuan Hsien (TW); Yi-Lin Chen, Taoyuan Hsien (TW); Chun-Ping Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 12 days.

(21) Appl. No.: 13/617,408

(22) Filed: Sep. 14, 2012

(65) Prior Publication Data

US 2013/0321114 A1 Dec. 5, 2013

(30) Foreign Application Priority Data

Jun. 5, 2012 (TW) ..... 101120820 A

(51) Int. Cl.

| | |
|---|---|
| ***H01F 27/29*** | (2006.01) |
| ***H01F 27/24*** | (2006.01) |
| ***H01F 27/28*** | (2006.01) |
| ***H01F 27/30*** | (2006.01) |
| ***H01F 27/32*** | (2006.01) |

(52) U.S. Cl.

CPC ..... *H01F 27/292* (2013.01); *H01F 27/325* (2013.01); *H01F 2027/297* (2013.01)

USPC ..... 336/192; 336/212; 336/182; 336/198; 336/220; 336/188

(58) Field of Classification Search

CPC ..... H01F 27/26; H01F 27/306; H01F 27/292; H01F 27/2804; H01F 17/0013; H01F 27/325; H01F 5/02; H01F 2005/043

USPC ..... 336/192, 212, 198, 182, 220, 222

See application file for complete search history.

(56) References Cited

U.S. PATENT DOCUMENTS

| | | | | |
|---|---|---|---|---|
| 5,008,644 | A * | 4/1991 | Cooper | 336/192 |
| 6,586,844 | B1 * | 7/2003 | Chang | 257/779 |
| 6,781,499 | B2 * | 8/2004 | Steiner | 336/192 |
| 8,242,871 | B2 * | 8/2012 | Kobayashi et al. | 336/198 |
| 8,334,745 | B2 * | 12/2012 | Chen et al. | 336/198 |

(Continued)

FOREIGN PATENT DOCUMENTS

| | | |
|---|---|---|
| GB | 2369933 | 6/2002 |
| JP | H08-64411 | 3/1996 |

*Primary Examiner* — Elvin G Enad
*Assistant Examiner* — Kazi Hossain
(74) *Attorney, Agent, or Firm* — Kirton McConkie; Evan R. Witt

(57) ABSTRACT

A transformer includes a bobbin, at least one primary winding coil, at least one secondary winding coil, and a magnetic core assembly. The bobbin includes a main body, plural extension structures, and plural pin groups. The main body includes a channel, plural winding sections, a first connecting seat, and a second connecting seat. The plural extension structures are connected with the first connecting seat and the second connecting seat, respectively. In addition, each of the plural extension structures has a notch and a stepped structure, and the stepped structure comprises plural stepped parts. Each of the primary winding coil and the secondary winding coil includes plural outlet terminals. The plural outlet terminals of the secondary winding coil are respectively disposed on the plural stepped parts of the stepped structure and fixed on the pin group which is disposed on one of the extension structures.

9 Claims, 4 Drawing Sheets

(56) References Cited

U.S. PATENT DOCUMENTS

2002/0075115 A1* 6/2002 Yeh et al. ..... 336/198
2007/0024406 A1* 2/2007 Hao ..... 336/208
2011/0221559 A1* 9/2011 Tsai et al. ..... 336/192
2011/0260820 A1* 10/2011 Liao ..... 336/192
2012/0038448 A1 2/2012 Kim et al.

* cited by examiner

TRANSFORMER

TECHNICAL FIELD

The present disclosure relates to a transformer, and more particularly to a transformer with an increased creepage distance between a magnetic core assembly and a secondary winding coil.

DESCRIPTION OF THE RELATED ART

Magnetic elements such as inductors and transformers are widely used in power supply apparatuses or many electronic devices to generate induced magnetic fluxes. A transformer is a device that transfers electric energy from one circuit to another through coils in order to regulate the voltage to a desired range required for powering the electronic device.

FIG. 1 is a schematic exploded view of a conventional transformer. As shown in FIG. 1, the transformer 1 comprises a bobbin 10, a primary winding coil 11, a secondary winding coil 12, and a magnetic core assembly 13. The primary winding coil 11 and the secondary winding coil 12 are wound around the bobbin 10. The outlet terminals 110 of the primary winding coil 11 and the outlet terminals 120 of the secondary winding coil 12 are wound around and fixed on pins 101, which are extended from two opposed sides of the bobbin 10. The magnetic core assembly 13 is combined with the bobbin 10, and partially embedded into a channel 102 of the bobbin 10. After the bobbin 10 and the magnetic core assembly 13 are combined together, the transformer 1 is assembled. Consequently, the transformer 1 may be electrically connected with a circuit board (not shown) through the pins 101.

Moreover, after the outlet terminals 110 of the primary winding coil 11 are wound around and soldered on the pins 101 at a first side of the bobbin 10, some drawbacks may occur. Since the gap between any two adjacent pins 101 at the first side of the bobbin 10 is very short, the region between two outlet terminals 110 of the primary winding coil 11 is possibly stained with solder paste. Under this circumstance, the transformer 1 is readily suffered from a short-circuited problem. Moreover, the creepage distance between the outlet terminals 110 of the primary winding coil 11 fixed on the pins 101 of the bobbin 10, the creepage distance between the outlet terminals 120 of the secondary winding coil 12 fixed on the pins 101 of the bobbin 10, the creepage distance between the outlet terminals 110 of the primary winding coil 11 and the magnetic core assembly 13 and the creepage distance between the outlet terminals 120 of the secondary winding coil 12 and the magnetic core assembly 13 are usually insufficient. Moreover, after the outlet terminals 120 of the secondary winding coil 12 are wound around and soldered on the pins 101 at a second side of the bobbin 10, the exposed portions of the secondary winding coil 12 are usually sheathed by tubes 14. The uses of the tubes 14 may protect the exposed portion of the secondary winding coil 12 from being cracked in response to the external force. Although the uses of the tubes 14 may protect the exposed portion of the secondary winding coil 12, there are still some drawbacks. For example, the procedure of sheathing the tubes 14 is time-consuming and labor-intensive. In addition, the uses of the tubes 14 increase the fabricating cost.

As mentioned above, the outlet terminals 110 of the primary winding coil 11 and the outlet terminals 120 of the secondary winding coil 12 are respectively fixed on the pins 101 at the two opposed sides of the bobbin 10 of the conventional transformer 1. Since the pins 101 are symmetrically arranged at the two opposed sides of the bobbin 10, during the process of mounting the transformer 1 on a circuit board (not shown), the worker may erroneously insert the pins of the transformer 1 into unmatched conductive holes (not shown) of the circuit board. Under this circumstance, the circuit board fails to be normally operated or even the circuit board has a breakdown. In other words, the conventional transformer 1 has no foolproof mechanism for facilitate the worker to mount the transformer on the circuit board. Moreover, for fabricating the transformer 1, the primary winding coil 11 and the secondary winding coil 12 are manually wound around the bobbin 10 and then the tubes 14 are sheathed around the secondary winding coil 12. The process of fabricating the transformer 1 is labor-intensive and time-consuming, and the fabricating cost is high. Moreover, since the winding coils are readily broken, the process of fabricating the transformer 1 wastes much material.

Therefore, there is a need of providing an improved transformer in order to eliminate the above drawbacks.

BRIEF SUMMARY

The present disclosure provides a transformer. The bobbin of the transformer has plural extension structures. Each of the plural extension structures has a notch and a stepped structure. Consequently, the creepage distance between a magnetic core assembly and a secondary winding coil will be increased, and the overall volume of the transformer is reduced.

The present disclosure also provides a transformer whose bobbin has a stepped structure. The stepped structure comprises plural stepped parts. Due to the altitude difference between every two adjacent stepped parts, the region between every two adjacent stepped parts may be defined as a wire-managing part. The outlet terminals of the secondary winding coil may be supported on the plural stepped parts. Consequently, the creepage distance between the outlet terminals of the secondary winding coil will be increased to meet the electric safety regulations.

The present disclosure further provides a transformer with good electrical properties to avoid the arcing effect. Moreover, the transformer may be fabricated by an automatic winding method, and the transformer may have a foolproof positioning mechanism.

In accordance with an aspect of the present disclosure, there is provided a transformer. The transformer includes a bobbin, at least one primary winding coil, at least one secondary winding coil, and a magnetic core assembly. The bobbin includes a main body, plural extension structures, and plural pin groups. The main body includes a channel, plural winding sections, a first connecting seat, and a second connecting seat. The plural extension structures are connected with the first connecting seat and the second connecting seat, respectively. In addition, each of the plural extension structures has a notch and a stepped structure, and the stepped structure comprises plural stepped parts. The plural pin groups are disposed on the first connecting seat, the second connecting seat and the plural extension structures. The at least one primary winding coil and at least one secondary winding coil are wound around the plural winding sections. Each of the at least one primary winding coil and the at least one secondary winding coil includes plural outlet terminals. The magnetic core assembly is partially embedded within the channel of the main body. The plural outlet terminals of the secondary winding coil are respectively disposed on the plural stepped parts of the stepped structure and fixed on the pin group which is disposed on one of the extension structures.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
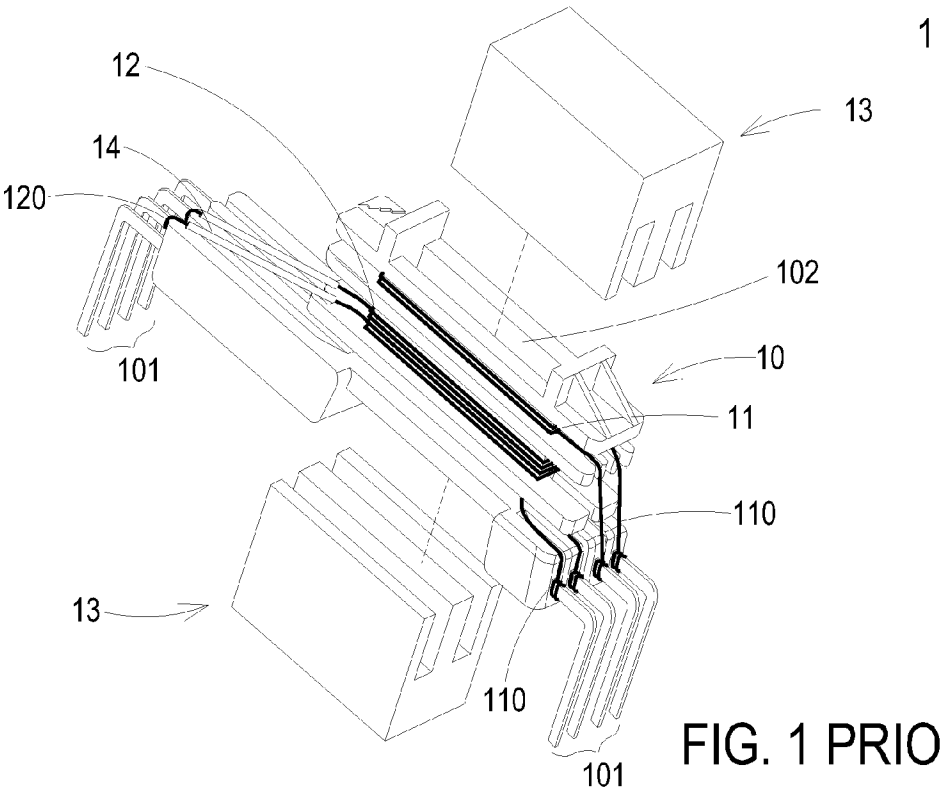
FIG. 1 PRIOR ART
FIG. 1 is a schematic exploded view of a conventional transformer.
Figure 2A:
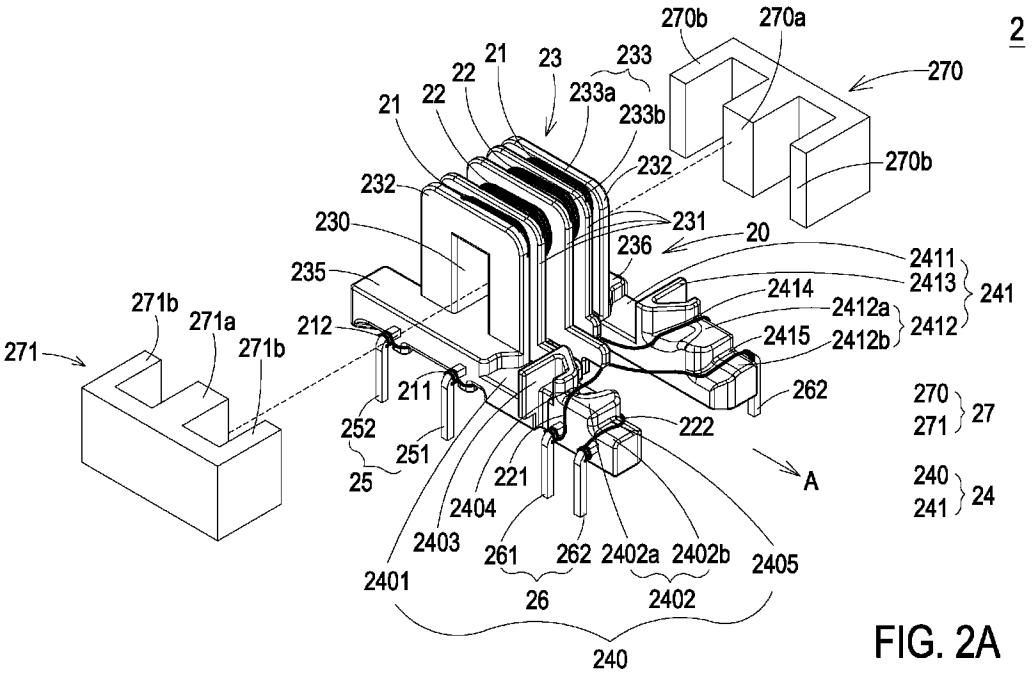
FIG. 2A is a schematic exploded view illustrating a transformer according to an embodiment of the present disclosure.
Figure 2B:
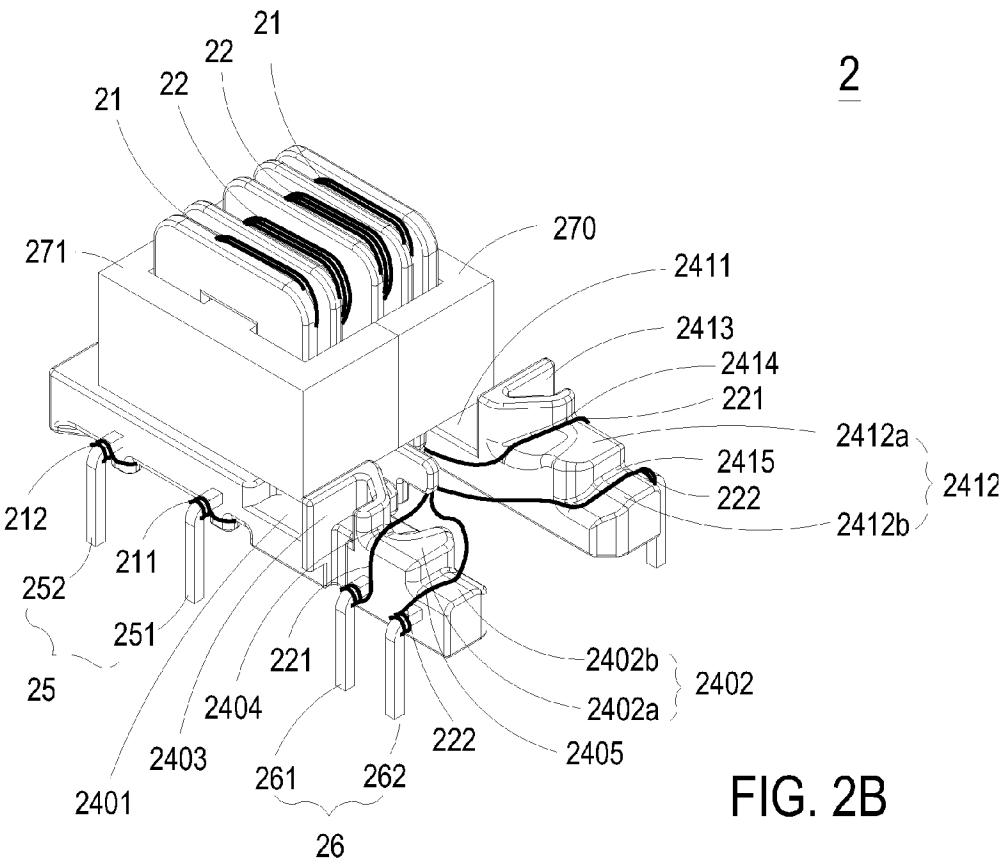
FIG. 2B is a schematic assembled view illustrating the transformer of FIG. 2A.

FIG. 2A is a schematic exploded view illustrating a transformer according to an embodiment of the present disclosure. FIG. 2B is a schematic assembled view illustrating the transformer of FIG. 2A. In this embodiment, the transformer of the present disclosure may be applied to a pulse transformer. As shown in FIG. 2, the transformer 2 comprises a bobbin 20, at least one primary winding coil 21, at least one secondary winding coil 22, and a magnetic core assembly 27. The at least one primary winding coil 21 and the at least one secondary winding coil 22 are wound around the bobbin 20. The bobbin 20 comprises a main body 23, plural extension structures 24, and plural pin groups. The main body 23 comprises a channel 230, plural winding sections 233, a first connecting seat 235, and a second connecting seat 236. The channel 230 runs through the main body 23. The at least one primary winding coil 21 and the at least one secondary winding coil 22 are wound around the plural winding sections 233. The first connecting seat 235 and the second connecting seat 236 are located at two opposed sides of the main body 23. The main body 23 further comprises plural partition plates 231 and two lateral plates 232. The two lateral plates 232 are located at the two opposed sides of the main body 23. The plural partition plates 231 are disposed on the main body 23 and arranged between the two lateral plates 232 at regular spacing intervals or irregular spacing intervals. In addition, the plural partition plates 231 are parallel with each other. Consequently, the plural winding sections 233 are defined by the plural partition plates 231 and the two lateral plates 232 collaboratively. In this embodiment, the plural winding sections 233 comprise plural first winding sections 233*a* and plural second winding sections 233*b*. The plural first winding sections 233*a* are located at bilateral sides of the plural second winding sections 233*b*. The at least one primary winding coil 21 is wound around the first winding sections 233*a* of the bobbin 20. The at least one secondary winding coil 22 is wound around the second winding sections 233*b* of the bobbin 20. In this embodiment, the bobbin 20 comprises two first winding sections 233*a* and two second winding sections 233*b*. It is noted that the numbers of the first winding sections 233*a* and the second winding sections 233*b* may be varied according to the practical requirements.

In this embodiment, the plural extension structures 24 comprise a first extension structure 240 and a second extension structure 241. The first extension structure 240 is connected with the first connecting seat 235 of the main body 23. The second extension structure 241 is connected with the second connecting seat 236 of the main body 23. In this embodiment, the first extension structure 240 and the second extension structure 241 are integrally extended from the first connecting seat 235 and the second connecting seat 236 of the main body 23, respectively. In addition, the first extension structure 240 and the second extension structure 241 are parallel with each other, and extend from the same side of the first connecting seat 235 and the second connecting seat 236. Take the first extension structure 240 for example. Along a direction distant from the main body 23 (e.g. along the direction A), at least one first notch 2401 and at least one first stepped structure 2402 are sequentially formed on the top surface of the first extension structure 240. The first notch 2401 is defined by a flank of the first connecting seat 235 and a stopping plate 2403 of the first extension structure 240 collaboratively. The first stepped structure 2402 is formed on the top surface of the first extension structure 240, and the first stepped structure 2402 comprises plural stepped parts whose altitudes are gradually decreased along the direction A. Please refer to FIGS. 2A and 2B. In this embodiment, the first stepped structure 2402 comprises a first stepped part 2402*a* and a second stepped part 2402*b*. (In other embodiments, the first stepped structure 2402 may comprise more stepped parts.) Moreover, the stopping plate 2403 is arranged between the first stepped part 2402*a* of the stepped structure 2402 and the first notch 2401. The altitude of the stopping plate 2403 is higher than the surface of the first stepped part 2402*a*. Due to the altitude difference between the stopping plate 2403 and the first stepped part 2402*a*, the region between the stopping plate 2403 and the first stepped part 2402*a* may be defined as a first wire-managing part 2404. Due to the altitude difference between the first stepped part 2402*a* and the second stepped part 2402*b*, the region between the first stepped part 2402*a* and the second stepped part 2402*b* may be defined as a second wire-managing part 2405. The first wire-managing part 2404 and the second wire-managing part 2405 are used for disposing different segments of the secondary winding coil 22 in order to manage the secondary winding coil 22.

In this embodiment, the second extension structure 241 also comprises at least one second notch 2411, at least one second stepped structure 2412, and a stopping plate 2413. Similarly, the second stepped structure 2412 also comprises a first stepped part 2412*a* and a second stepped part 2412*b*. Similarly, due to the altitude difference between the stopping plate 2413 and the first stepped part 2412*a*, the region between the stopping plate 2413 and the first stepped part 2412*a* may be defined as a first wire-managing part 2414. Similarly, due to the altitude difference between the first stepped part 2412*a* and the second stepped part 2412*b*, the region between the first stepped part 2412*a* and the second stepped part 2412*b* may be defined as a second wire-managing part 2415. Similarly, the first wire-managing part 2414 and the second wire-managing part 2415 are used for disposing different segments of the secondary winding coil 22 in order to manage the secondary winding coil 22.

Figure 3:
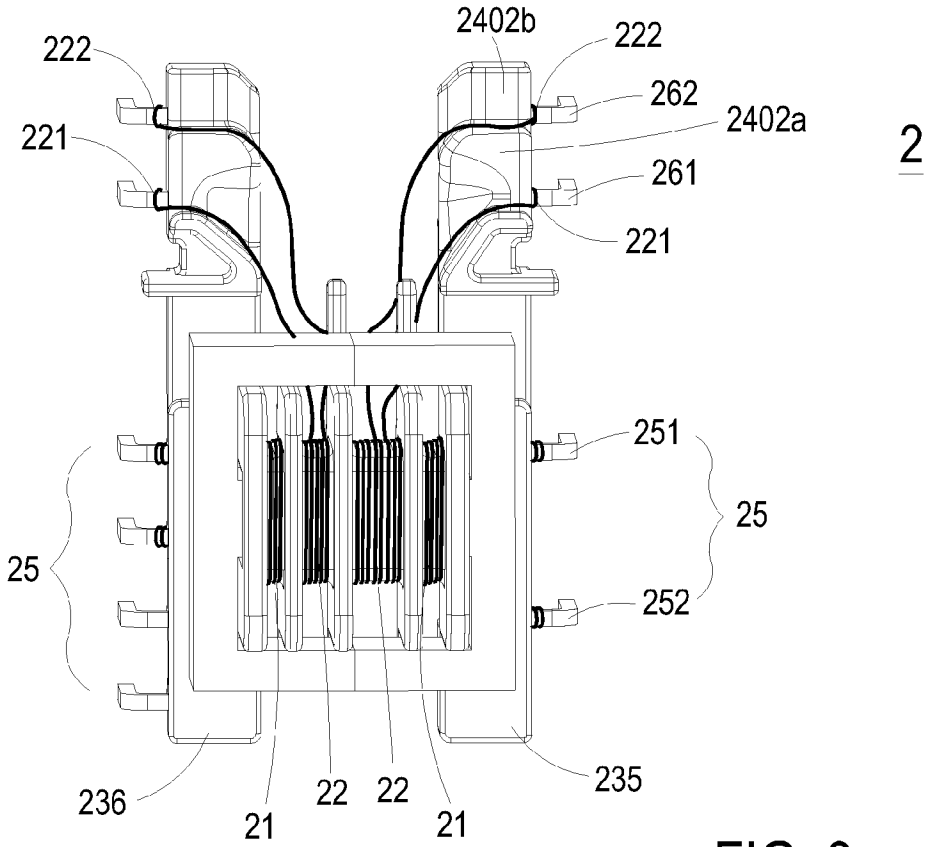
FIG. 3 is a schematic top view illustrating the transformer of FIG. 2B.

Please refer to FIGS. 2A and 2B again. The plural pin groups of the bobbin 20 comprise plural first pin groups 25 and plural second pin groups 26. The plural first pin groups 25 are disposed on the outer surfaces of the first connecting seat 235 and the second connecting seat 236 of the main body 23. The outlet terminals of the primary winding coil 21 are wound around and fixed on the plural first pin groups 25. The plural second pin groups 26 are disposed on the outer surfaces of the first extension structure 240 and the second extension structure 241. The outlet terminals of the secondary winding coil 22 are wound around and fixed on the plural second pin groups 26. In some embodiments, the plural pins of the first pin group 25 on the first connecting seat 235 and the plural pins of the first pin group 25 on the second connecting seat 236 are arranged in an asymmetric form or a staggered form. Alternatively, the number of the plural pins of the first pin group 25 on the first connecting seat 235 may be different from the number of the plural pins of the first pin group 25 on the second connecting seat 236. FIG. 3 is a schematic top view illustrating the transformer of FIG. 2B. As shown in FIG. 3, the number of the plural pins of the first pin group 25 on the first connecting seat 235 is different from the number of the plural pins of the first pin group 25 on the second connecting seat 236. Since the plural pins of the first pin group 25 are specially arranged, the plural pins of the first pin group 25 may provide a foolproof positioning function. When the transformer 2 is mounted on a circuit board (not shown), the possibility of erroneously inserting the pins into the unmatched conductive holes of the circuit board will be minimized. Moreover, each of the plural second pin groups 26 comprises plural pins 261 and 262 corresponding to the stepped parts 2402*a* and 2402*b*, respectively, or corresponding to the stepped parts 2412*a* and 2412*b*, respectively. In this embodiment, each of the plural second pin groups 26 comprises two pins. It is noted that the number of the pins of the second pin group 26 may be varied according to the practical requirements.

Please refer to FIGS. 2A and 2B again. The magnetic core assembly 27 comprises a first magnetic part 270 and a second magnetic part 271. The first magnetic part 270 comprises a middle portion 270*a* and two leg portions 270*b*. The second magnetic part 271 also comprises a middle portion 271*a* and two leg portions 271*b*. In this embodiment, the first magnetic part 270 and the second magnetic part 271 are E cores, so that the magnetic core assembly 27 is an EE-type magnetic core assembly. In some embodiments, the first magnetic part 270 and the second magnetic part 271 of the magnetic core assembly 27 are collaboratively defined as a UI-type magnetic core assembly or an EI-type magnetic core assembly. Moreover, in this embodiment, the middle portion 270*a* of the first magnetic part 270 and the middle portion 271*a* of the second magnetic part 271 are embedded into the channel 230 of the main body 23.

Please refer to FIGS. 2A and 2B again. The primary winding coil 21 has outlet terminals 211 and 212, and the secondary winding coil 22 has outlet terminals 221 and 222. A process of assembling the transformer 2 will be illustrated as follows. Firstly, the primary winding coil 21 and the secondary winding coil 22 are respectively wound around the first winding sections 233*a* and the second winding sections 233*b* of the bobbin 21. Then, the outlet terminals 211 and 212 of the primary winding coil 21 are directed through corresponding guiding recesses at the bottom of the first connecting seat 235 of the main body 23 of the bobbin 20. Then, the outlet terminals 211 and 212 of the primary winding coil 21 are respectively wound around and fixed on the pins 251 and 252 of the first pin group 25, which are disposed on the first connecting seat 235. The outlet terminals 221 and 222 of the secondary winding coil 22 come out from the bottom of the main body 23. The outlet terminal 221 of the secondary winding coil 22 is directed through the first wire-managing part 2404 of the first extension structure 240 and fixed on the pin 261 of the second pin group 26. The outlet terminal 222 of the of the secondary winding coil 22 is directed through the second wire-managing part 2405 of the first extension structure 240 and fixed on the pin 262 of the second pin group 26. In this embodiment, the ways of winding, managing and fixing another primary winding coil 21 and another secondary winding coil 22 on the second connecting seat 236 and the second extension structure 241 of the bobbin 20 are similar to those of the primary winding coil 21 and the secondary winding coil 22 mentioned above, and are not redundantly described herein. After the primary winding coils 21 and the secondary winding coils 22 are fixed on the pin groups 25 and 26, the middle portion 270*a* of the first magnetic part 270 and the middle portion 271*a* of the second magnetic part 271 are embedded into the channel 230 of the main body 23, and the leg portions 270*b* and 271*b* are located at bilateral sides of the main body 23 of the bobbin 20. Meanwhile, the transformer 2 is assembled.

From the above description, the bobbin 20 of the transformer 2 of the present disclosure has plural extension structures 24. The plural extension structures 24 comprise the notches 2401, 2411 and the stepped structures 2402, 2412. So that when the volume of the bobbin 20 of the transformer 2 of the present disclosure is equal to the volume of the bobbin of the conventional transformer, the arrangement of the notches 2401 and 2411 can increase the creepage distance between the magnetic core assembly 27 and the secondary winding coil 22. In other words, the overall volume of the transformer 2 of the present disclosure may be reduced with the proviso that the creepage distance of the transformer 2 meets the electric safety regulations. Moreover, due to the stepped parts 2402*a*, 2402*b*, 2412*a* and 2412*b* of the stepped structures 2402 and 2412 of the extension structures 24 of the bobbin 20, it is not necessary to use the insulating tubes to separate the outlet terminals 221 and 222 of the secondary winding coil 22 from each other. Moreover, since the creepage distance between the outlet terminals 221 and 222 of the secondary winding coil 22 may be increased to meet the electric safety regulations, the possibility of generating the arching effect at the regions between the outlet terminals 221 and 222 of the secondary winding coil 22 and the pins 261 and 262 will be minimized. Moreover, since the first wire-managing parts 2404, 2414 and the second wire-managing parts 2405, 2415 may be used for storing the segments of the secondary winding coil 22, the efficacy of protecting and managing the secondary winding coil 22 can be reached. Moreover, the transformer 2 of the present disclosure has good electrical properties and may be fabricated by an automatic winding method. Moreover, by adjusting the arrangements or the numbers of the plural pins of the first pin group 25 on the first connecting seat 235 and the plural pins of the first pin group 25 on the second connecting seat 236, the transformer 2 may have a foolproof positioning mechanism.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer, comprising:

a bobbin comprising:

a main body comprising a channel, plural winding sections, a first connecting seat, and a second connecting seat;

plural extension structures connected with said first connecting seat and said second connecting seat, respectively, wherein each of said plural extension structures has a notch, a stopping plate and a stepped structure, and said stepped structure comprises a first stepped part and a second stepped part, said plural extension structures are integrally extended from said first connecting seat and said second connecting seat of said main body, respectively, said main body is ran through by said channel along a first direction, said plural extension structures are parallel with each other and extended along a second direction from the same side of said first connecting seat and said second connecting seat, each of said second stepped part is extended from said stopping plate along said second direction, respectively, said first direction is perpendicular to said second direction, said stopping plate has an altitude higher than a surface of said first stepped part, a region between said stopping plate and said first stepped part is defined as a first wire-managing part, said first stepped part has an altitude higher than a surface of said second stepped part, and a region between said first stepped part and said second stepped part is defined as a second wire-managing part; and plural pin groups disposed on said first connecting seat, said second connecting seat and said plural extension structures;

at least one primary winding coil and at least one secondary winding coil wound around said plural winding sections, wherein each of said at least one primary winding coil and said at least one secondary winding coil comprises plural outlet terminals; and a magnetic core assembly partially embedded within said channel of said main body, wherein said plural outlet terminals of said secondary winding coil are respectively disposed on said first wire-managing part and said second wire-managing part and fixed on said pin group which is disposed on one of said extension structures.

2. The transformer according to claim 1, wherein said main body of said bobbin further comprises plural partition plates and two lateral plates, wherein said two lateral plates are located at two opposed sides of said main body, wherein said plural partition plates and said two lateral plates are disposed on said main body at regular spacing intervals or irregular spacing intervals and parallel with each other, wherein said plural winding sections are defined by said plural partition plates and said two lateral plates collaboratively.

3. The transformer according to claim 1, wherein said plural winding sections comprise plural first winding sections and plural second winding sections, wherein said plural first winding sections are located at bilateral sides of said plural second winding sections, wherein said at least one primary winding coil is wound around said plural first winding sections of the bobbin, and said at least one secondary winding coil is wound around said plural second winding sections.

4. The transformer according to claim 1, wherein along a direction distant from said main body, said notch and said stepped structure are sequentially formed on a top surface of each extension structure.

5. The transformer according to claim 1, wherein said plural extension structures of said bobbin comprise:

a first extension structure connected with said first connecting seat, and comprising at least one first notch, a first stopping plate and at least one first stepped structure, wherein said first notch is defined by a flank of said first connecting seat and said first stopping plate of said first extension structure collaboratively; and a second extension structure connected with said second connecting seat, and comprising at least one second notch, a second stopping plate and at least one second stepped structure, wherein said second notch is defined by a flank of said second connecting seat and said second stopping plate of said second extension structure collaboratively.

6. The transformer according to claim 1, wherein said plural pin groups comprise plural first pin groups and plural second pin groups, wherein said plural first pin groups are disposed on said first connecting seat and said second connecting seat of said main body, and said outlet terminals of said primary winding coil are wound around and fixed on said plural first pin groups, wherein said plural second pin groups are disposed on said first extension structure and said second extension structure, and said outlet terminals of said secondary winding coil are wound around and fixed on said plural second pin groups.

7. The transformer according to claim 6, wherein plural pins of said first pin group on said first connecting seat and plural pins of said first pin group on said second connecting seat are specially arranged to collaborative define a foolproof mechanism.

8. The transformer according to claim 1, wherein said magnetic core assembly comprises a first magnetic part and a second magnetic part, wherein each of said first magnetic part and said second magnetic part comprises a middle portion and plural leg portions, wherein said middle portion is embedded into said channel of said main body, and said plural leg portions are located at bilateral sides of said main body of said bobbin.

9. The transformer according to claim 1, wherein said magnetic core assembly is an EE-type magnetic core assembly, an EI-type magnetic core assembly or a UI-type magnetic core assembly.

* * * * *